United States Patent [19]

Tsuji

[11] 3,964,351

[45] June 22, 1976

[54] TORQUE WRENCH

[75] Inventor: Hiroshi Tsuji, Tokyo, Japan

[73] Assignee: Tonichi Manufacturing Co., Ltd., Tokyo, Japan

[22] Filed: Aug. 6, 1975

[21] Appl. No.: 602,230

[30] Foreign Application Priority Data

Aug. 7, 1974 Japan ..... 49-94426[U]

[52] U.S. Cl. ..... 81/52.4 R

[51] Int. Cl.[2] ..... B25D 23/142; B25D 23/145; B25D 23/147

[58] Field of Search ..... 81/52.4 R, 52.5

[56] References Cited

UNITED STATES PATENTS

| | | | |
|---|---|---|---|
| 3,018,677 | 1/1962 | Mutolo et al. | 81/52.5 |
| 3,132,548 | 5/1964 | Livermont | 81/52.5 |
| 3,355,970 | 12/1967 | Knudsen et al. | 81/52.4 R |

*Primary Examiner*—James L. Jones, Jr.
*Attorney, Agent, or Firm*—Toren, McGeady and Stanger

[57] ABSTRACT

A preset type torque wrench, in which another link is arranged in series to an ordinary toggle link between a head and a thruster, so that after the toggle link is actuated, said another link is further actuated, where by the head continues to turn at a large angle relatively to a grip part.

Thus, the generation of any excessive torque can be prevented.

2 Claims, 9 Drawing Figures

TORQUE WRENCH

BACKGROUND OF THE INVENTION

The present invention relates to the improvement of a preset type torque wrench, comprising that a conventional wide-used toggle link is employed and said toggle link is actuated when a torque reaches a preset value, whereby it can be sensed that the torque reaches a preset value. In case of such a kind of torque wrench, hitherto an over-torque has been sometimes given on a bolt by inertia before an operator decreases his manual force even if it is sensed that the torque reaches a preset value. In order to prevent the above, a head is further turned from a grip part after the torque link is actuated, so that the power of habit of the operator can be absorbed.

DESCRIPTION OF THE PREFERRED EMBODIMENT

Figure 1:
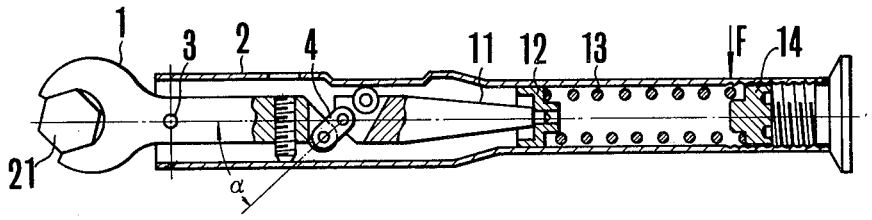
FIG. 1 shows a conventional preset type torque wrench.
Figure 2:
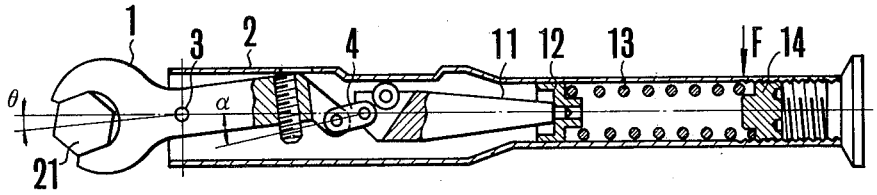
FIG. 2 shows the condition of the above, in which a toggle link is actuated.

The construction shall be explained in detail as follows:

FIGS. 1 and 2 show a conventional preset type torque wrench. A head 1 to be engaged with a bolt 21 is fixed by a pin 3 to a tube 2, serving also for a grip part. The other end of the head (1) is connected with a toggle link 4 at an angle of $\alpha$, and further, the other end of the toggle link 4 is fixed to a thruster 11. The force, applied to the toggle link 4 is changed into an axial force by the thruster 11, which receives the compressive force of a spring 13 by means of a spring shoe 12. In order to adjust the compressive force of the spring 13 for making the actuating torque value change, an adjusting screw 14 is fixed by a screw to the tube 2.

The grip part of the tube 2 is applied with a manual force F to screw the bolt 21. When the torque reaches a preset value, the axial component, given by the toggle link 4 overcomes the compressive force of the spring 13 and compresses the spring 13. Then, the toggle link 4 stands up and the angle $\alpha$ becomes small. The head 1 turns from the tube 2 at an angle of $\theta$. The end part of the head 1 strikes on the tube 2 and stops. See FIG. 2.

Figure 3:
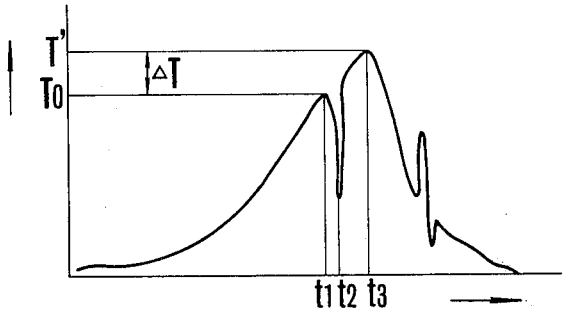
FIG. 3 shows how the torque changes with time.

The change of the torque value during this time is shown in FIG. 3. When $t_1$, the torque reaches a preset value $T_o$ and the toggle link 4 begins to operate. The torque value is decreased by the toggle action until the head 1 strikes on the tube 2 at $t_2$. By this sudden drop of the torque or the noise, made when the head 1 strikes the tube 2, the operator can be noticed with that the torque reaches a preset value. However, the operator continues by inertia during about 5/100 sec. to screw the bolt by increasing the torque even after $t_2$ at the same rate of increase of the torque as before $t_1$. The manual force F is made decreased only on arriving at $t_3$. Consequently, the largest value of the torque, applied to the bolt 21, becomes T′ and the torque, which is by $\Delta T$ larger than a preset torque value $T_o$, is given to the bolt 21.

Figure 4:
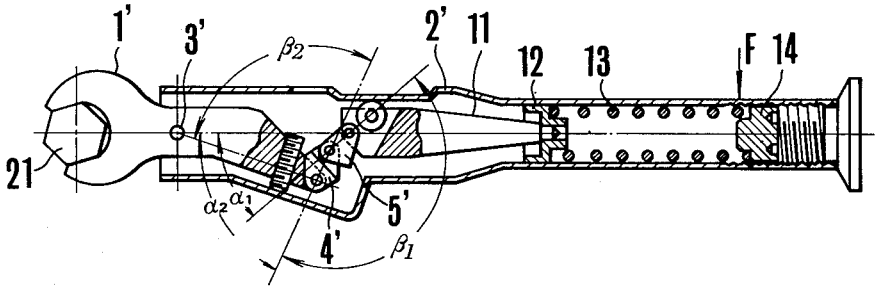
FIG. 4 shows a preset type torque wrench according to the present invention.
Figure 5:
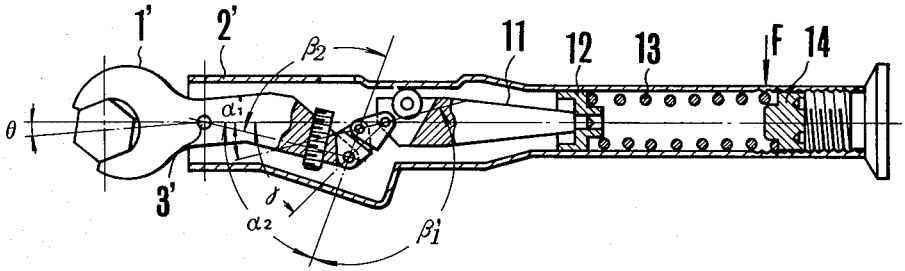
FIG. 5 shows the condition of the above, in which a link-A is actuated.
Figure 6:
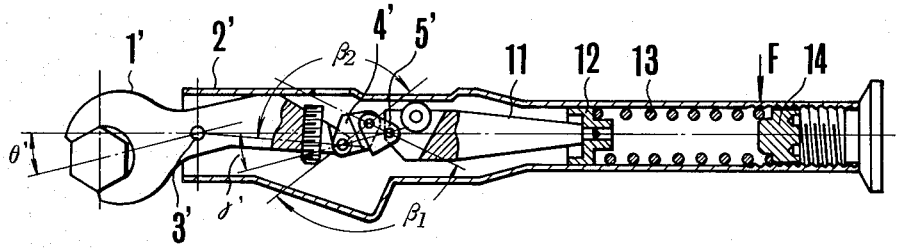
FIG. 6 shows the condition of the above, in which both links A and B are actuated.

The preset type torque wrench according to the present invention is so made as not to generate such an excessive torque. The construction and operation are shown in FIGS. 4, 5 and 6. A head 1′ to screw the bolt 21 is fixed by a pin 3′ to a tube 2′, serving also for a grip part. The other end of the head 1′ is connected with a link-B 4′. The link-B 4′ is pressed by a spring force to the head 1′ at an angle of $\beta_2$. A link-A 5′ is connected with the other end of the link-B 4′ at an angle of $\alpha_1$. The other end of the link-A 5′ is connected with a thruster 11. Then, the thruster 11 is connected with a spring 13 by means of a spring shoe 12 as shown in a conventional type. The other end of the spring 13 is so retained by an adjusting screw 14 as to adjust the compressive force of the spring 13 for making the actuating torque change. The adjusting screw 14 is fixed by a screw to the tube 2′.

Referring to FIG. 4, in case of $\alpha_2 > \alpha_1$, if a preset torque is obtained by applying a manual force F, the link-A 5′ is first actuated to compress the spring 13. The link-A 5′ stands up and the angle becomes $\alpha_1'$ (refer to FIG. 5). Then, while being pressed to the head 1′, the link-B 4′ moves with the head 1′ as one body. The head 1′ turns by $\theta$ by the action of the link-A 5′. The link-A 5′ stands up to be at an angle of $\beta_1'$ to the link-B 4′. The link-A 5′ strikes the link-B 4′ and stops. Then, similarly to a conventional preset type torque wrench, the sudden drop of the torque and the noise, made when the link-A 5′ strikes the link-B 4′, give a notice to the operator to the effect that the torque reaches a preset value. If the operator continues by inertia further to apply a manual force F, the link-A 5′ and the link-B 4′ are integrated to form a linkage and the angle becomes $\gamma$. Said link-A 5′ and link-B 4′ are actuated as one body until the angle becomes $\gamma$. The head 1 turns further until it touches the tube 2′. Refer to FIG. 6.

Figure 7:
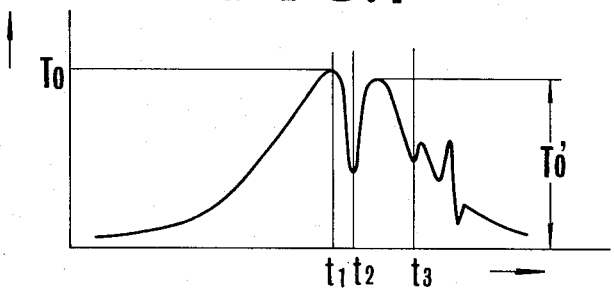
FIG. 7 shows how the torque of a torque wrench changes with time according to the present invention.

The change of the torque value during this time is shown in FIG. 7. The manual force F is increased before $t_1$ and the torque reaches a preset value $T_o$. Then, the link-A 5′ is actuated and the torque is decreased by the toggle action. The link-A 5′ strikes the link-B 4′. By this noise and the sudden drop of the torque the operator is noticed with that the torque reaches a preset value $T_o$, but continues by inertia to apply his manual force. Then, the link-A 5′ and the link-B 4′ become one body to form a linkage and operate. If it is made to be $\gamma < \alpha_1$, the active torque $T_o'$ is smaller than $T_o$, so that any excessive torque is not generated. If this secondary action is performed during the time of more than 5/100 sec., an ordinary operator can decrease his manual force F before the finish of the secondary action, so that the generation of any excessive force can be prevented.

Figure 8:
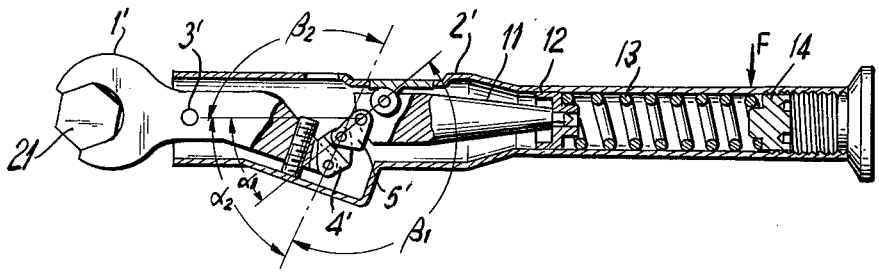
FIG. 8 shows the same torque wrench shown in FIG. 4 except that a roller receiving member is provided.
Figure 9:
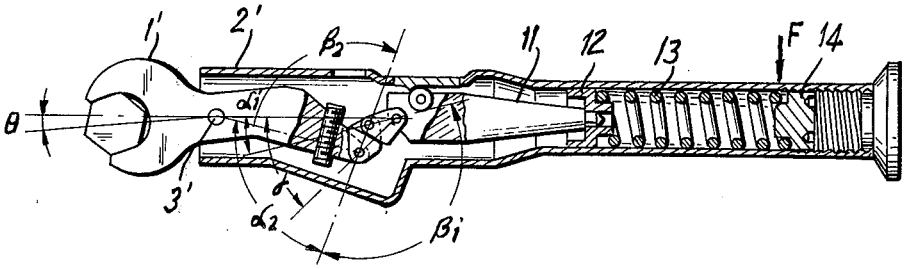
FIG. 9 shows the same torque wrench shown in FIG. 5, but in a state just after the link is actuated.

In order to make $T_o'$ smaller than $T_o$ without fail, the surface of the roller receiving member may be inclined as ahown in FIGS. 8 and 9, so as to change the ratio between $T_o$ and $T_o'$. Thus, when the link-A is actuated (FIG. 8), the surface is inclined so as to increase the working torque $T_o$, while when the link-B is actuated (FIG. 9), the surface is inclined so as to decrease the working torque $T_o'$.

The examples, shown in FIGS. 4 to 6, are respectively one embodiment of the present invention, in which the link-A 5' is first actuated and then the link-A 5' and the link-B 4' become one body and operate. However, the following examples are also covered by the present invention.

i. The link-A is actuated and then, only the link-B operates.
ii. The link-B is actuated and then, only the link-A operates.
iii. The link-B is actuated and then the link-A and link-B operate.
iv. The link-A and link-B are actuated and then the link-A operates.
v. The link-A and link-B are actuated and then the link-B operates.

What is claimed is:

1. A preset type torque wrench comprising that the end of a head, which is engaged with a bolt to be screwed, is connected with a toggle link, the other end of which is so connected with a thruster as to compress a spring, whereby when the torque reaches a preset value, the toggle link is actuated to compress the spring, so that the head turns relatively to a grip part, applied with a manual force, characterized in that another link is arranged in series to said toggle link between the head and the thruster, so that after the toggle link is actuated, said another link is further actuated, whereby the head continues to turn at a large angle relatively to the grip part.

2. A preset type torque wrench according to claim 1, in which the thruster is provided with a roller which rolls on an inclined surface of a roller receiving member so as to change torque when the toggle link and the another link are actuated.

* * * * *